US009669521B2

(12) United States Patent
Scheper

(10) Patent No.: US 9,669,521 B2
(45) Date of Patent: Jun. 6, 2017

(54) ADJUSTABLE SPANNER

(75) Inventor: Hilgines Roelof Scheper, Gouda (NL)

(73) Assignee: ICAMAT B.V., MJ Moordrecht (NL)

( * ) Notice: Subject to any disclaimer, the term of this patent is extended or adjusted under 35 U.S.C. 154(b) by 0 days.

(21) Appl. No.: 14/003,753

(22) PCT Filed: Mar. 7, 2012

(86) PCT No.: PCT/NL2012/000020

§ 371 (c)(1),
(2), (4) Date: Sep. 18, 2013

(87) PCT Pub. No.: WO2012/121588

PCT Pub. Date: Sep. 13, 2012

(65) Prior Publication Data

US 2014/0000416 A1 Jan. 2, 2014

(30) Foreign Application Priority Data

Mar. 8, 2011 (NL) ..... 1038646

(51) Int. Cl.
*B25B 13/12* (2006.01)
*B25B 13/08* (2006.01)
*B25B 13/10* (2006.01)

(52) U.S. Cl.
CPC ..... *B25B 13/12* (2013.01); *B25B 13/08* (2013.01); *B25B 13/10* (2013.01)

(58) Field of Classification Search
CPC ..... B25B 13/32; B25B 13/16; B25B 13/18; B25B 13/14; B25B 13/20; B25B 13/12; B25B 13/28; B25B 13/44; B25B 13/466; B25B 13/30; B25B 15/04; B25B 45/12; B25B 13/08; B25B 13/10
USPC ..... 81/77, 165, 129, 129.5, 146, 125.1, 179, 81/131, 462, 321, 177.8, 333, 112; 29/1, 29/6; 13/32, 16, 18, 14, 20, 12, 28, 44, 13/466, 30; 15/4; 45/12
See application file for complete search history.

(56) References Cited

U.S. PATENT DOCUMENTS 685,389 A * 10/1901 Tupper ..... 81/77
1,242,097 A * 10/1917 Anderson ..... 81/128
1,440,950 A * 1/1923 Allen ..... 81/77
(Continued)

FOREIGN PATENT DOCUMENTS

DE 202005011242 U1 10/2005
FR 372816 A 4/1907
GB 2196888 A 5/1988

OTHER PUBLICATIONS

International Search Report dated Sep. 21, 2012 for International Application No. PCT/NL2012/000020.

*Primary Examiner* — Hadi Shakeri
(74) *Attorney, Agent, or Firm* — Knobbe, Martens, Olson & Bear, LLP

(57) ABSTRACT

An adjustable spanner is provided. The adjustable spanner may comprise a pair of jaw arms, co-operating to move relative to one another, the co-operating jaw arms are each provided at their ends with a jaw, wherein two adjacent jaws constitute a spanner head; a housing for receiving the co-operating jaw arms, the co-operating jaw arms slide longitudinally relative to the housing for setting pre-selected discrete standard fastener sizes, wherein the jaw arms are substantially identical, and are received in the housing being rotated 180° relative to one another about their longitudinal axis.

23 Claims, 8 Drawing Sheets

(56) References Cited

U.S. PATENT DOCUMENTS

| | | | | | |
|---|---|---|---|---|---|
| 1,444,907 | A | * | 2/1923 | Fisher | 81/77 |
| 1,478,512 | A | | 12/1923 | Fisher | |
| 2,293,002 | A | * | 8/1942 | Huffman | 81/321 |
| 4,065,986 | A | | 1/1978 | Meggs et al. | |
| 4,151,763 | A | * | 5/1979 | Colvin | 81/77 |

* cited by examiner

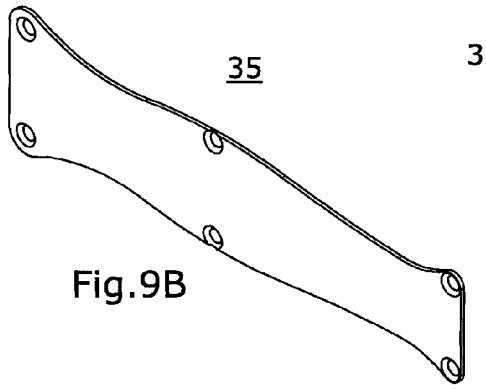
Fig.9B
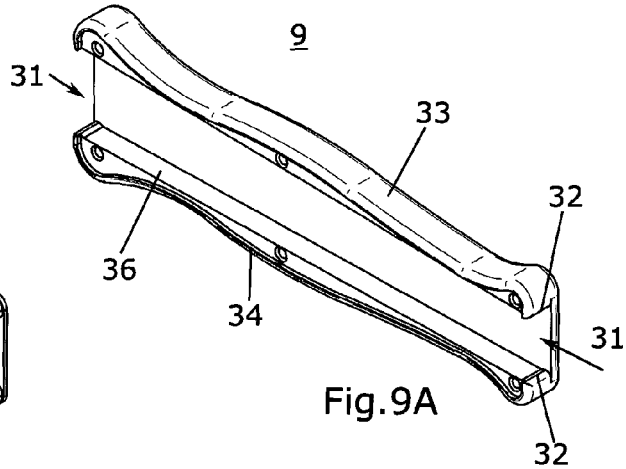
Fig.9A
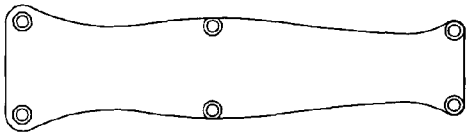
Fig.9D
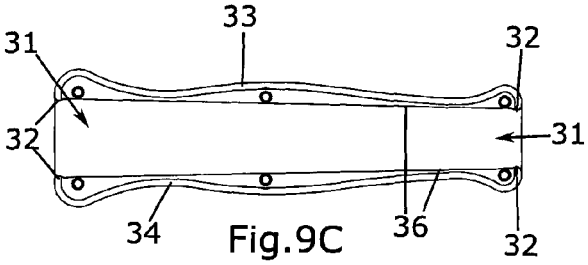
Fig.9C
Fig.9F
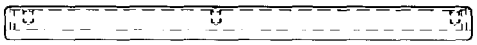
Fig.9E

ADJUSTABLE SPANNER

CROSS REFERENCE TO RELATED APPLICATIONS

This application is the U.S. National Phase of International Application No. PCT/NL2012/000020, filed Mar. 7, 2012, designating the U.S. and published as WO 2012/121588 on Sep. 13, 2012 which claims the benefit of Dutch Patent Application No. 1038646 filed Mar. 8, 2011.

BACKGROUND

The Field of Invention

The invention relates to an adjustable spanner comprising:

a pair of jaw arms, co-operating to move relative to one another, the co-operating jaw arms are each provided at their ends with a jaw, wherein two adjacent jaws constitute a spanner head, a housing for receiving the co-operating jaw arms, wherein the ends of the jaws extend outside the housing, the co-operating jaw arms slide longitudinally relative to the housing, thereby mutually tilting the jaw arms relative to one other due to the sliding, so that the jaws of the spanner head of the co-operating jaw arms move in opposite transverse direction relative to one other.

Description of the Related Art

This adjustable spanner is a constructive advantageous variant on the famous 'English key' or adjustable angle-head wrench. The screw adjusted spanner, by means of a worm gear, has a size-adjustable jaw width and can therefore, within certain limits, be adjusted to any size hex or square fastener head, nut or bolt, so that there is no need to have standby a large amount of fixed spanners or socket wrenches for a range of different fastener head sizes.

The adjustable spanner, however, has the disadvantage that it is difficult to accurately set the correct desired fit-size of the fastener head. Furthermore when the screw mechanism is worn out the set head size may wander off when exerting a torque force. With an improperly set jaw size the bolt or nut head may be damaged irreparably.

SUMMARY

With the adjustable spanner type according to the invention the spanner head may be easily adjusted into preselected discrete standard fastener head sizes by moving a pair of jaw arms.

DETAILED DESCRIPTION OF CERTAIN ILLUSTRATIVE EMBODIMENTS

Such an adjustable spanner is known from British patent application nr. 2196888. This known adjustable spanner consists of two co-operating jaw arms in a housing, which jaw arms by means of a slide member, provided with teeth, can be moved or reciprocated in the housing so as to adjust both spanner heads and also to be able to select a standard fastener head size.

This construction, however, is complicated and requires the use of many different parts; in addition, the two jaw arms are each other's mirror image and must therefore each be manufactured separately. The jaw arms each are supported by specially shaped hardened guides at each end of the housing, thereby rendering the manufacture of this adjustable spanner time consuming and costly. Moreover, adjusting the spanner heads is difficult and cumbersome.

Object of the invention is therefore to provide for an adjustable spanner, without the above-mentioned disadvantages, which is simple and can be easily manufactured from a small number of parts, which can be easily assembled, which remains firmly locked in a selected fastener head size, which does not require a slide member with teeth, and which does not require costly and complicated guides for each jaw arm on each end of the housing.

These objects of the invention are achieved by an adjustable spanner as described in the preamble wherein the jaw arms are substantially identical and are received in the housing being rotated 180° relative to one another about their longitudinal axis.

By applying two identical jaw arms it is not necessary to manufacture this essential part of the spanner—the jaw arm, by which the momentum force is exerted on the heads of the nuts and the bolts—in two mutually different versions, thereby realizing large savings on time and costs.

A special embodiment is characterized in that the jaw arm comprises a central portion and two jaws, wherein the central portion of the jaw arm is provided with a guide slot and a cam.

Preferably the guide slot is substantially transverse-oriented and the cam is provided substantially in line with the guide slot.

In particular the cams are inserted into the guide slots of the adjacent jaw arm, in the co-operative position of the pair of jaw arms, thereby forming the pivot point of the mutual tilting movement.

The pivot point of the co-operating jaw arms is formed with the above measures, by using two equal jaw arms without needing additional parts and by providing each arm with a cam and a guide slot at the side of the central portion having the thickened jaws.

In an alternative advantageous embodiment the jaw arm comprises a central portion and two jaws, wherein the jaws are provided with a greater thickness than the central portion, preferably the jaws are about twice as thick as the central portion.

As a result, at both ends of the adjustable spanner by the thickened jaws on the jaw arms, a spanner head is formed, between which a hexagonal or square nut or bolt head may be clamped in order to be able to exert a rotational torque moment on them.

In an advantageous embodiment the thickened jaws comprise a jump or step in thickness; preferably steps in thickness are provided at both ends on the same side of the jaw arm.

By providing the steps in thickness on the same side of the jaw arm and by providing the other side with an substantially flat surface, it is possible by rotating one jaw arm about its longitudinal axis, to form two adjustable spanner heads with two identical jaw arms.

In particular the angle of the step in thickness, between the jaw and the longitudinal axis, is about the same but opposite magnitude, as the angle between the lower longitudinal edge or the upper longitudinal edge respectively and the longitudinal axis.

As a result, in the closed position of the spanner head, a recess for a hexagonal nut is exactly formed because the longitudinal edges exactly abut against the step of the jaw of the other jaw arm.

The embodiment is preferred wherein the jaw arm at its upper longitudinal edge and its bottom longitudinal edge is provided with a spring fastening means; preferably the spring fastening means is a recess.

In particular the pivot point divides the jaw arm into two arm portions, wherein the spring fastening means are provided on different arm portions.

By providing the spring fastening means on both sides of the pivot point, the two jaw arms are provided with a pre-load bias tension, so that without having to use a sliding member, the jaw arms can be locked in the housing or can be unlocked and subsequently moved and adjusted.

Advantageous is the embodiment wherein a pair of tension springs are provided, wherein in the co-operative position of the pair of jaw arms, the two tension springs are connected to the spring fastening means located at the top or bottom longitudinal edges of the two jaw arms.

In particular the tension spring is a leaf spring wherein the ends are provided with connection elements, preferably the leaf spring is provided with a step corresponding to the distance between the longitudinal edges of the pair of jaw arms in co-operative position.

With two tension springs, each provided at the upper side and at the bottom side in the housing, each engaging on both jaw arms, the co-operating jaw arms each are provided with a pre-tension. The pre-tension is directed towards moving the two jaw arms away from each other about the pivot point, so that the jaws are biased against the housing. Because the springs engage on the arm parts of each jaw arm, a step is provided in the leaf springs, wherein the dimension of the step corresponds to the distance between the two jaw arms.

It is desirable for an effective use that the shoulders of the two jaws of the jaw arm are provided with teeth; preferably the teeth are formed in the thickened jaw, and comprise a row of concave-shaped recesses.

Preferably the housing at both ends is provided with an opening for the jaw arms, wherein the inner edges of the openings, located opposite the longitudinal sides of the jaw arms, are provided with a shape corresponding to the teeth on the shoulders of the jaw, preferably they are convex-shaped, so that an inner edge can engage in the recesses of the teeth, and lock the jaw arms.

In particular the ends of the top and bottom walls of the housing are flanged to form the inner edges of the opening.

With these measures a simple, inexpensive and very effective adjusting mechanism with interlocking is obtained. The shoulders of the jaws of the jaw arms are provided with teeth, which co-operate with the inner edge of the openings of the housing. Due to the applied pre-tension by means of the springs, these teeth on the shoulders are clamped against the inside edge, so that the jaw arms are locked in the openings of the housing. The jaw arms may subsequently be released by moving them towards each other against the spring pre-tension, so that the jaw arms in the housing can be slid and shifted, and a different fastener size can be selected. By providing the recesses and the inner edges with an equal, but opposite, shape, the inner edge of the housing fits exactly into the recess of the jaw arm and a good interlocking is obtained. It has been found that with concave-shaped recesses and with convex-shaped inner edges a good, reliable and wear-resistant locking is obtained.

By folding the edges of the top and/or bottom walls of the housing at their ends, advantageously in a simple manner, the interlocking can be formed without any additional parts being necessary.

The invention also relates to an adjustable spanner comprising:

a pair of jaw arms, co-operating to move relative to one another, the co-operating jaw arms are each provided at their ends with a jaw, wherein two adjacent jaws constitute a spanner head, a housing for receiving the co-operating jaw arms, wherein the ends of the jaws extend outside the housing, the co-operating jaw arms slide longitudinally relative to the housing, thereby mutually tilting the jaw arms relative to one other due to the sliding, so that the jaws of the spanner head of the co-operating jaw arms move in opposite transverse direction relative to one other, and wherein the shoulders of the two jaws of the jaw arm are provided with teeth.

The invention also relates to an adjustable spanner comprising:

a pair of jaw arms, co-operating to move relative to one another, the co-operating jaw arms are each provided at their ends with a jaw, wherein two adjacent jaws constitute a spanner head, a housing for receiving the co-operating jaw arms, wherein the ends of the jaws extend outside the housing, the co-operating jaw arms slide longitudinally relative to the housing, thereby mutually tilting the jaw arms relative to one other due to the sliding, so that the jaws of the spanner head of the co-operating jaw arms move in opposite transverse direction relative to one other, and wherein the jaw arm at its upper longitudinal edge and its bottom longitudinal edge is provided with a spring fastening means, and wherein a pair of tension springs is provided, wherein in the co-operative position of the pair of jaw arms, the two tension springs are connected to the spring fastening means at the top or bottom longitudinal edges of the two jaw arms.

The invention is further explained by means of a drawing and an embodiment of the wall of the adjustable spanner, whereby other preferred features and advantages of the invention will be apparent.

Figure 5:
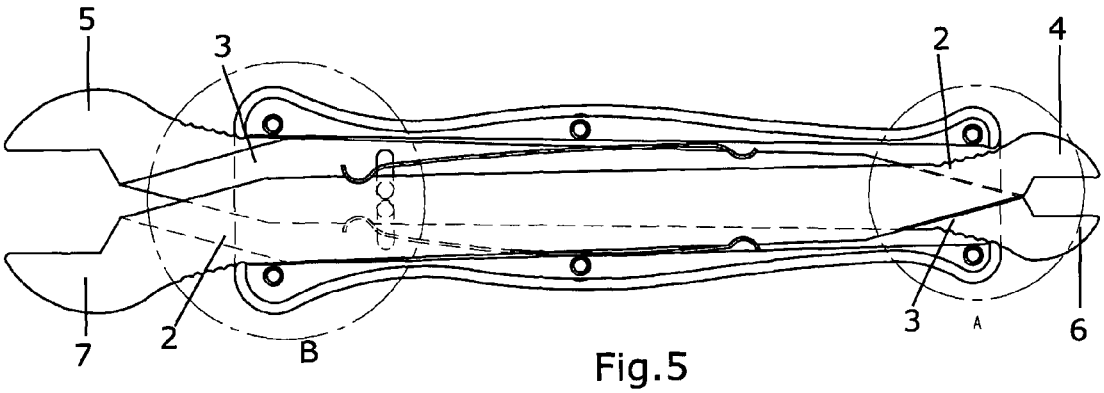
FIG. 5 shows a side view of the adjustable spanner with jaw arms fully shifted to the left in the housing.
Figure 6:
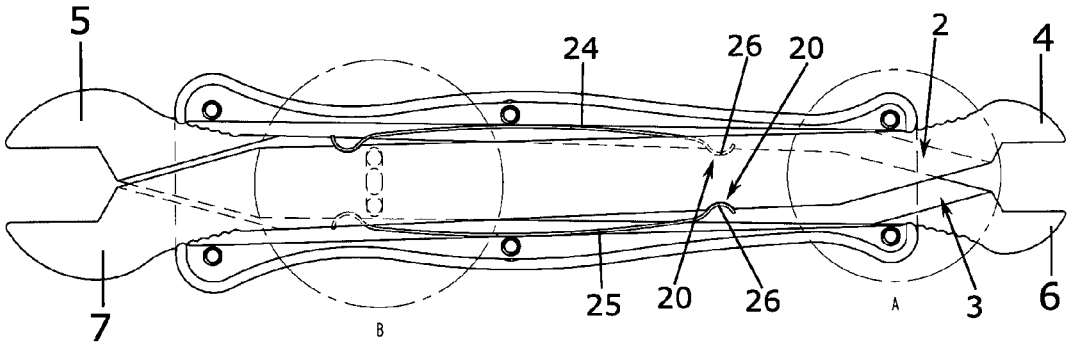
FIG. 6 shows the adjustable spanner of FIG. 4.
Figure 6B:
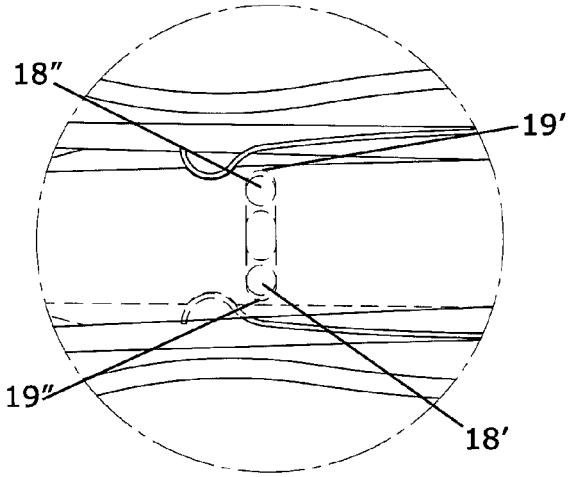
FIG. 6A shows an enlarged detail A with the locking elements.
Figure 7:
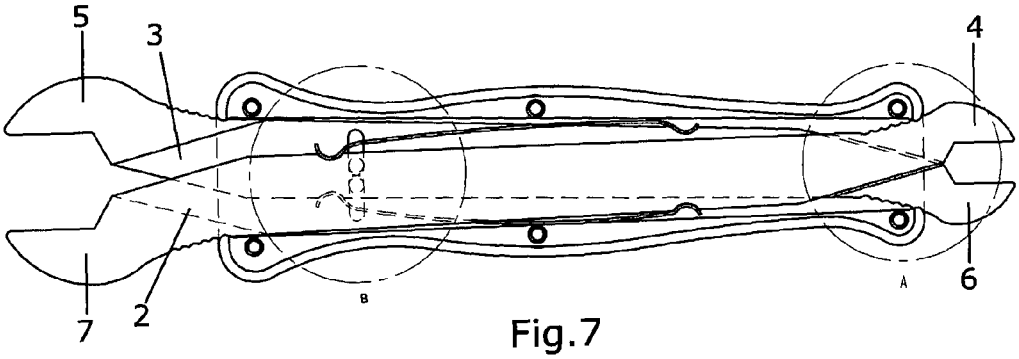
Figure 7B:
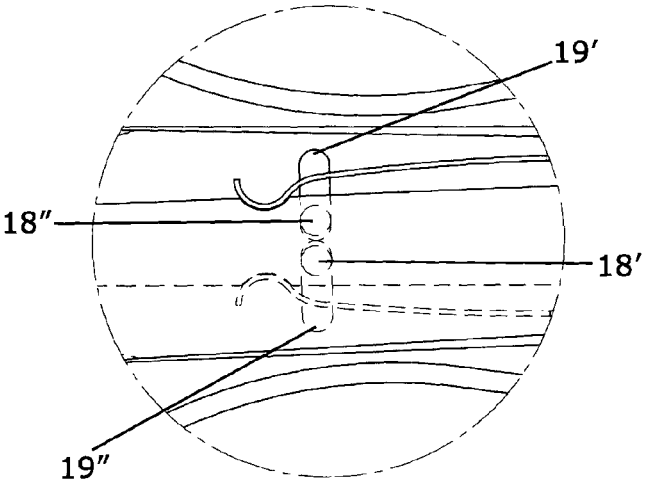
Figure 7A:
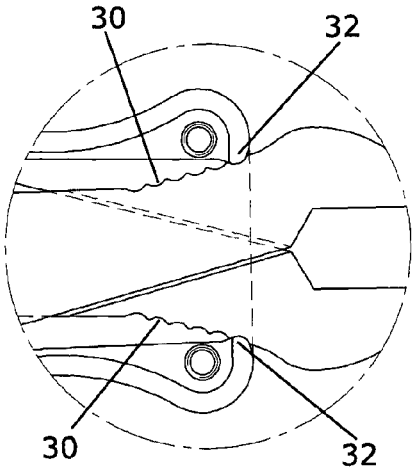
Figure 8A:
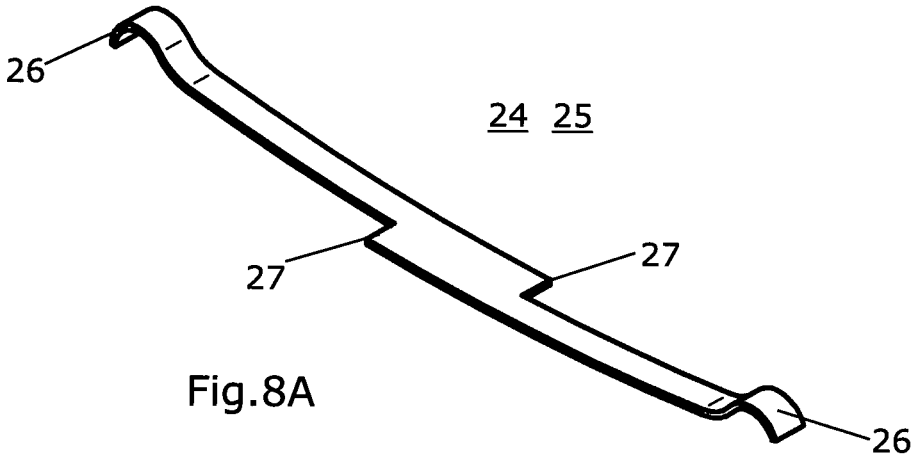
Figure 8B:
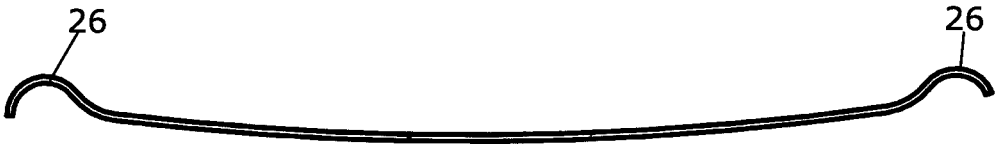
Figure 8C:
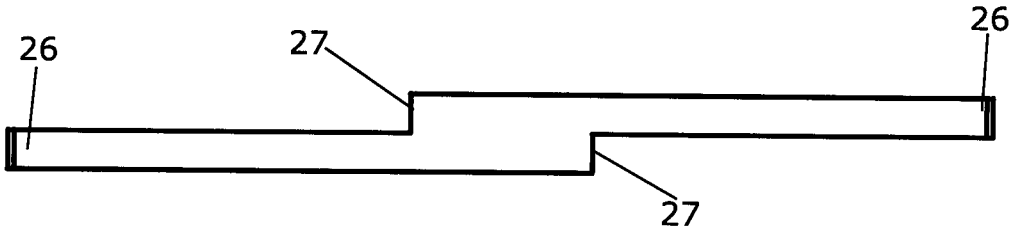

FIG. 6*b* shows an enlarged detail B of the cams and guide slots mutually inserted into each another;

FIG. 7 shows the adjustable spanner of FIG. 5;

FIG. 7A shows an enlarged detail A of FIG. 5 with fully closed spanner head;

FIG. 7B shows an enlarged detail B of FIG. 5 with the position of the cams and guide slots, and with fully opened left-hand spanner head;

FIG. 8A shows a perspective view of the spring element for the jaw arms;

FIG. 8B shows a side view of the spring FIG. 8A;

FIG. 8C shows a bottom view of the spring FIG. 8A;

FIG. 9A, 9C, 9E show an perspective view, side view and bottom view of the housing;

FIG. 9B, 9D, 9F show an perspective view, side view and bottom view of the cover of the housing.

Figure 1:
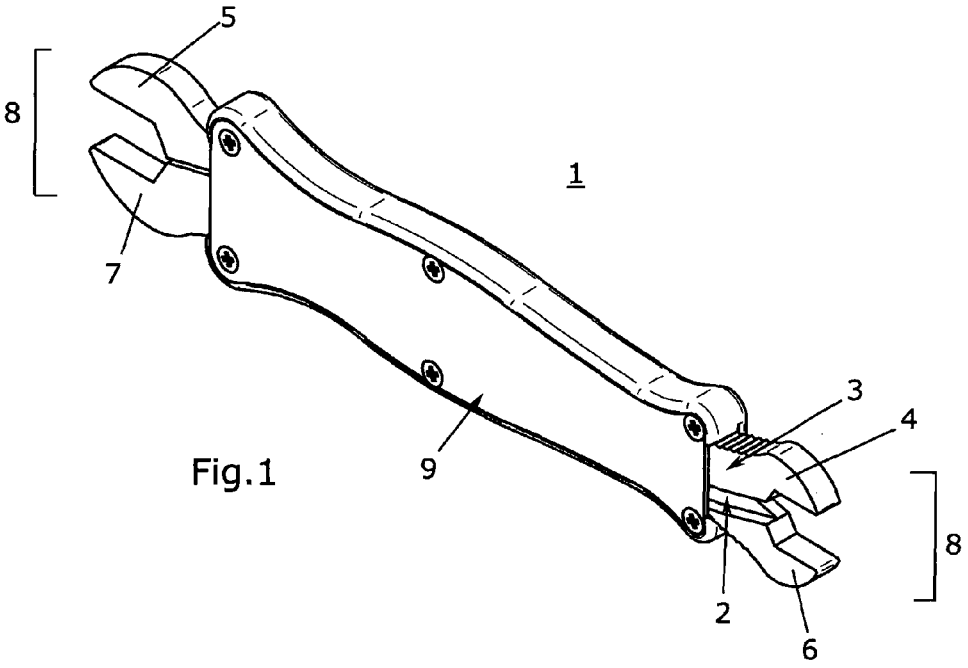
FIG. 1 shows a perspective view of the adjustable spanner according to the invention.

FIG. 1 shows the adjustable spanner 1 according to the invention with the housing 9 and the jaw arms 2, 3 arranged therein. At the ends of front jaw arm 3—in the drawing—are provided right jaw 4 and left jaw 7, and at the ends of the rear jaw arm 2 are provided jaws 6 and 5. Left-hand jaws 5, 7 and right-hand jaws 4, 6 form at each end an adjustable spanner head 8 which can be positioned on the nut and bolt heads in order to rotate the nut and/or bolt head. By longitudinally sliding and shifting the pair of jaw arms relative to the housing 9, a different standard spanner size can be set, such as for example, six different sizes at each end with 6-11 mm at the right-hand end in the drawing and from 12 to 17 mm at the left-hand end.

Figure 2A:
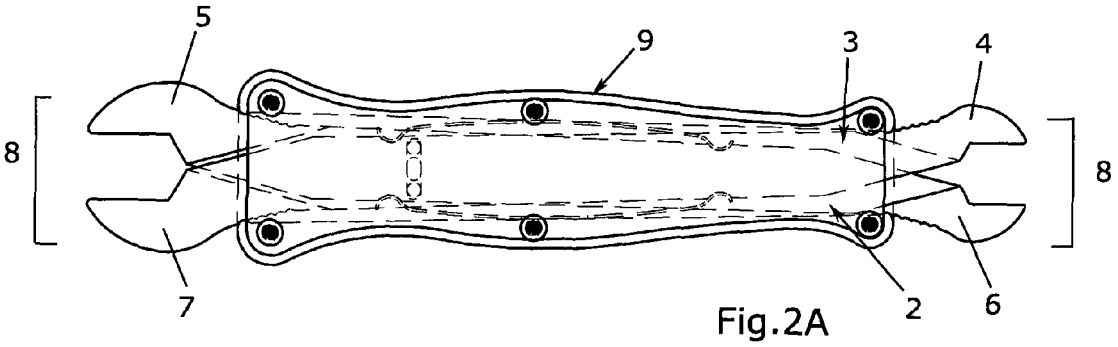
FIG. 2A shows, partially cutaway, a side view of the adjustable spanner of FIG. 1.

In FIG. 2A a partially cut away and transparent adjustable spanner is shown with rear jaw arm 2 and superimposed front jaw arm 3. The pair of jaw arms is fully shifted to the right so that the left-hand spanner head 8 is closed and the right-hand spanner head is fully opened so that, for instance, left a size of 12 mm is selected, and right a size of 11 mm.

Figure 2B:
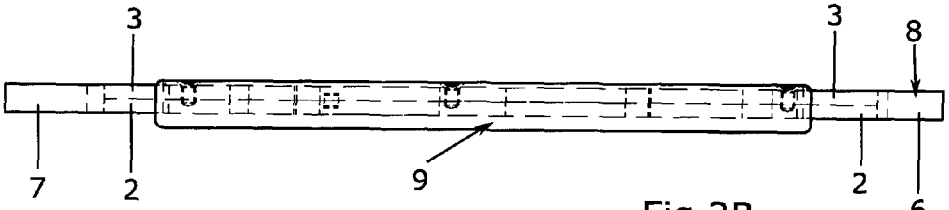
FIG. 2B shows a bottom view of the adjustable spanner of FIG. 1.

FIG. 2B shows a bottom view of the adjustable spanner with housing 9 and spanner head 8. By means of the dotted lines can be seen that the two jaw arms 2, 3 abut against each other, in which left-hand jaw 7 of jaw arm 3 is positioned on the left-hand side at the bottom side and the right-hand jaw 6 of jaw arm 2 is positioned on the right-hand side at the bottom side.

Figure 3A:
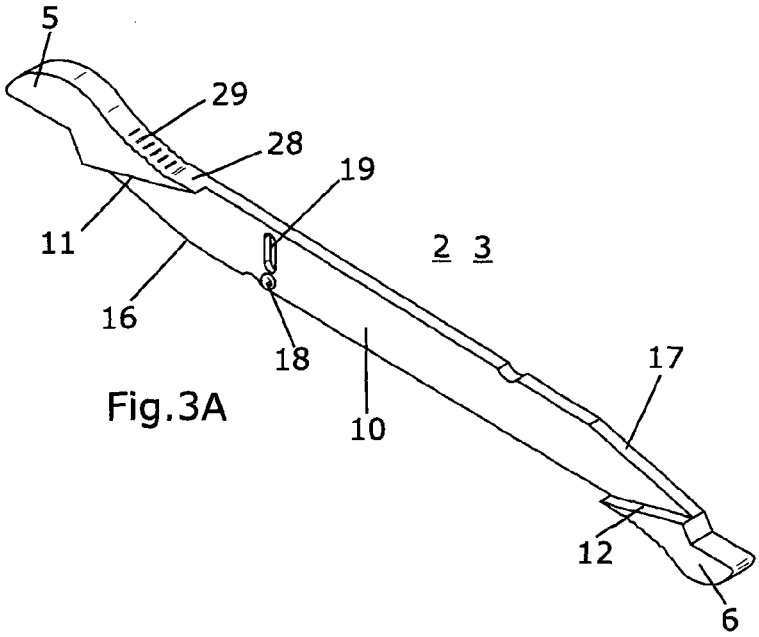
FIG. 3A shows a perspective view of the jaw arm according to the invention.

FIG. 3A shows the elongate jaw arm 2 according to the invention, which also can be used as second jaw arm 3 by rotating about its longitudinal axis. The jaw arm 2 comprises a flat centre portion 10 and two jaws 5, 6 at its ends. Upper longitudinal edge 17 is in this embodiment the flat upper side of the central portion 10 of the jaw arm 2 having a width equal to the thickness of the central portion 10. Bottom longitudinal edge 16 is the flat bottom side of the central portion 10. The jaws 5, 6 are formed thickened, transforming with a step in thickness 11, 12 into in the centre portion 10. The thickened jaws are provided with a shoulder 28. Furthermore, the jaw arm 2 is provided with a guide slot 19, and a cam 18. The guide slot 19 extends substantially in the width direction i.e. transversely oriented, and the cam 18 is positioned in line with the guide slot 19. The width of the cam 18 is preferably chosen such that the cam 18 snugly fits into the guide slot 19. As a result, the two jaw arms 2, 3 are coupled to each other in a tilting and shifting manner.

Figure 3B:
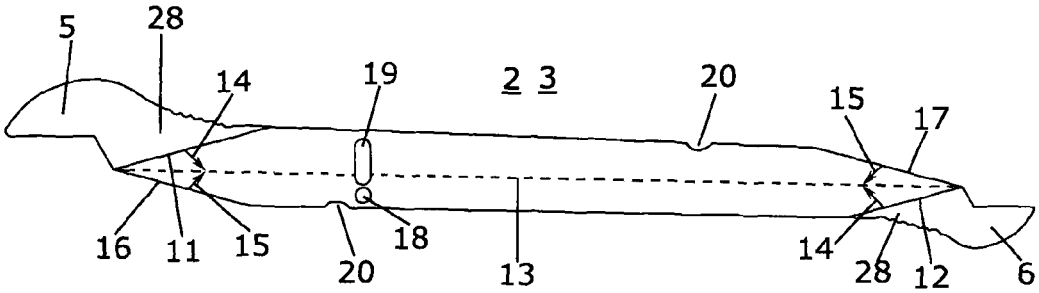
FIG. 3B shows a side view of the jaw arm of FIG. 3A.

FIG. 3B shows in side view the jaw arm 2 of FIG. 3A with the longitudinal axis 13 shown in dotted lines. When the identical jaw arm 3 is rotated 180° around the longitudinal axis 13, the two jaw arms 2, 3 can be mutually coupled into a co-operating pair. Upper longitudinal edge 17 extends, at least substantially, flat and parallel to the longitudinal axis 13 from the shoulder 28 of left-hand jaw 5 to the right-hand jaw 6. Near the right-hand jaw 6 the longitudinal edge 17 is provided with an angle 15 with respect to the longitudinal axis 13. Bottom longitudinal edge 16 extends, at an angle 14 with the longitudinal axis 13, from starting point jaw 5 and then parallel to the longitudinal axis 13 to the shoulder 28 of the jaw 6. Both the step in thickness 11 of jaw 5 as well as the step in thickness 12 of jaw 6, are at an angle 15 to the direction of the longitudinal axis 13. In a preferred embodiment, angle 14 and angle 15 are approximately equal, so that—in the closed position of the spanner head concerned—the bottom longitudinal edge 16 abuts fittingly against the step in thickness 11 and the upper longitudinal edge 17 abuts fittingly against the step in thickness 12 (see also FIG. 4B). The longitudinal edges 16, 17 are provided with spring fastening means 20, here arranged as recesses 20.

Figure 3C:
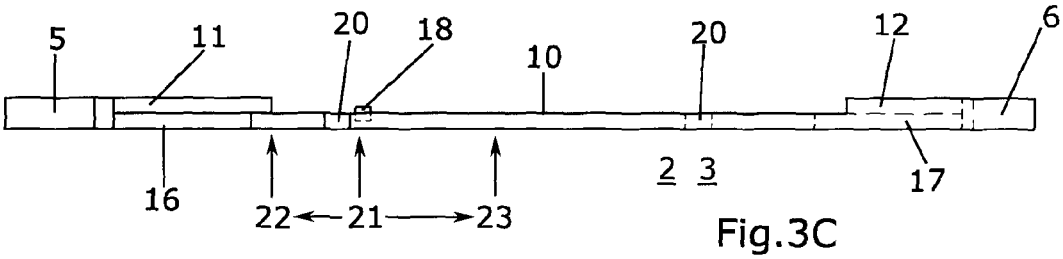
FIG. 3C shows a bottom view of the jaw arm of FIG. 3A.

In FIG. 3C is shown the jaw arm 2 of FIG. 3A-3B in a bottom view. It is clearly shown that the steps in thickness 11 and 12 are arranged on the same side of the jaw arm 2. Projection i.e. cam 18 extends also on the same side, and defines, together with the guide slot 19, the pivot point 21 of the (tilting) movement of the coupled jaw arms 2, 3. The pivot point 21 divides the jaw arm 2 into two arm portions 22, 23, in which the spring fastening means 20 are each provided on opposite arm portions 22, 23 on opposite longitudinal edges 16, 17.

Figure 4:
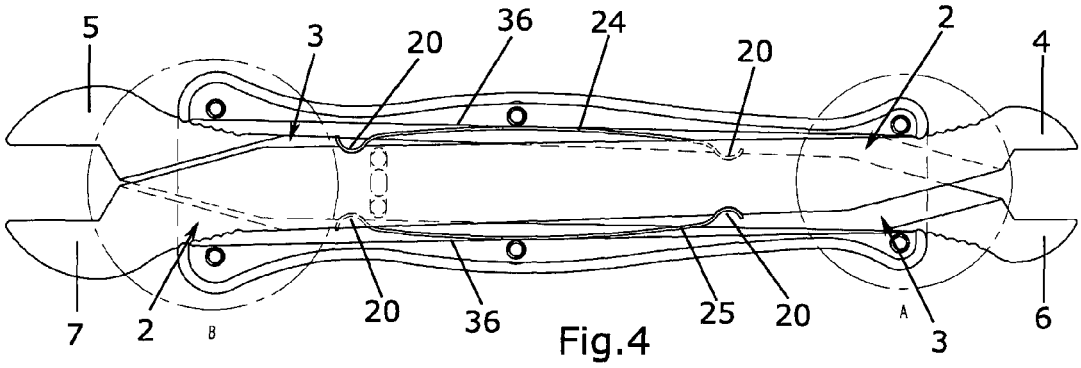
FIG. 4 shows in more detail in side view the adjustable spanner with opened housing having jaw arms fully shifted to the right in the housing.

FIG. 4 shows the opened housing containing the mounted jaw arms 2, 3, and the two tension springs 24, 25. The tension springs, which are shown in more detail in FIG. 8A, 8B, 8C, are connected to the spring fastening means 20 of the jaw arms and lay against the inner walls 36 of the housing, which inner walls 36 are shown in more detail in FIG. 9A-9E. The co-operating jaw arms 2, 3 are fully shifted to the right with respect to the housing, so that the right-hand jaws 4, 6 are opened, and the left-hand jaws 5, 7 are closed. The tension springs 24, 25 each engage the spring fastening means on the upper jaw arm 2 and the rear jaw arm 3, and are pre-tensioned or biased by internal walls 36. The tension springs 24, 25 together exert a spring force, driving apart the co-operating, coupled, jaw arms 2, 3 so that the jaws 4-7 are biased against the housing.

Figure 4B:
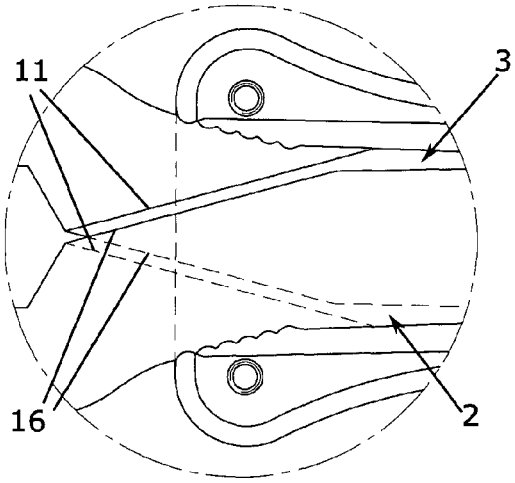
FIG. 4B shows an enlarged detail B of FIG. 4 with closed spanner head.

In FIG. 4B is enlarged shown detail circle B of FIG. 4 with bottom longitudinal edges 16 and step in thickness 11 of the jaw arms 2, 3. Due to the chosen equal angles 14, 15 (see FIG. 3B), the step in thickness 11 and the bottom longitudinal edge 16 are closely fitting together.

Figure 4A:
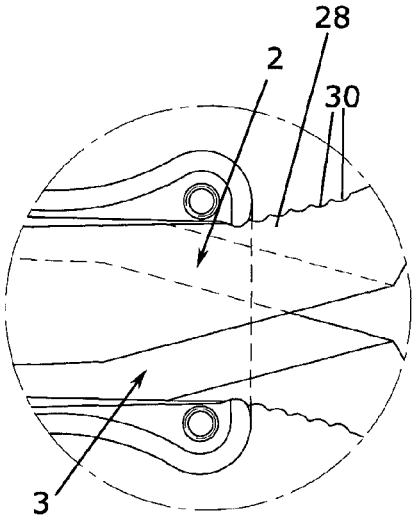
FIG. 4A shows an enlarged detail A of FIG. 4 with the spanner head fully open.

In FIG. 4A is enlarged shown detail circle A of FIG. 4 with shoulder 28 and the recesses 30 arranged thereupon to form teeth for locking.

Figure 5B:
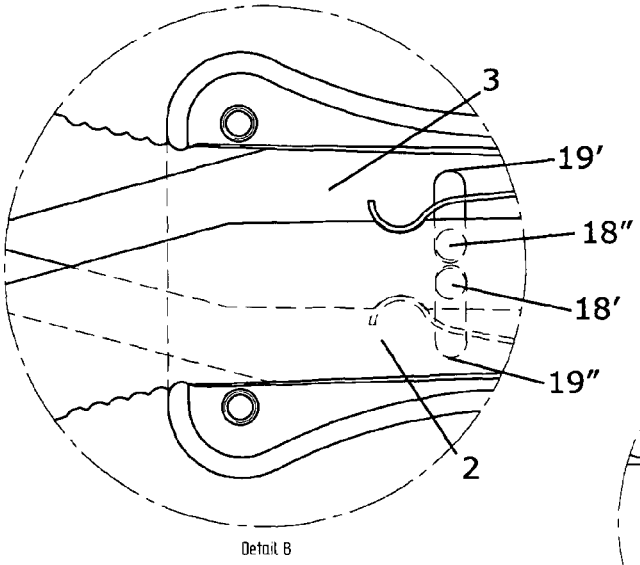
FIG. 5B shows an enlarged detail B of FIG. 5 with fully open spanner head.
Figure 5A:
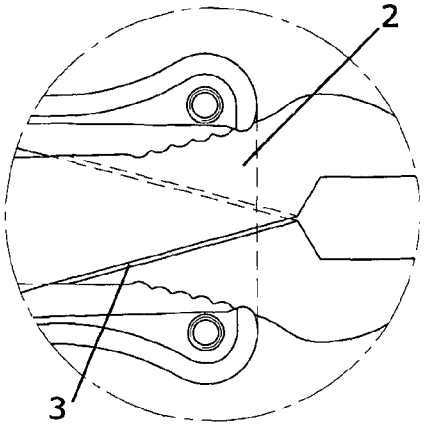
FIG. 5A shows an enlarged detail A of FIG. 5 with fully closed spanner head.

FIG. 5 and the detailed FIGS. 5A and 5B show the co-operating jaw arms 2, 3 which have been fully shifted to the left with respect to the housing, so that the right-hand jaws 4, 6 are closed and the left-hand jaws 5, 7 are open.

In FIG. 6 the position of the jaw arms 2, 3 of FIG. 4 is shown with arc-shaped connection elements 26 of leaf springs 24, 25 that engage in recesses 20.

In FIG. 6B is shown enlarged in detail how, in the closed position of the jaws 5, 7, cam 18' of the rear jaw arm 3 is slid into the bottom position in the guide slot 19" of the upper jaw arm 2, while simultaneously the cam 18" of the front jaw arm 2 is slid into the top position of the guide slot 19' of rear jaw arm 3.

In FIG. 7B is shown enlarged detail circle B of FIG. 7 in the open position of the jaws 5, 7, in which the cam 18' of the lower jaw arm 3 is slid into the top position of the guide slot 19' of the front jaw arm 2, and simultaneously the cam 18" of the front jaw arm 2 is slid into the bottom position of the guide slot 19' of the lower jaw arm 3.

Figure 6A:
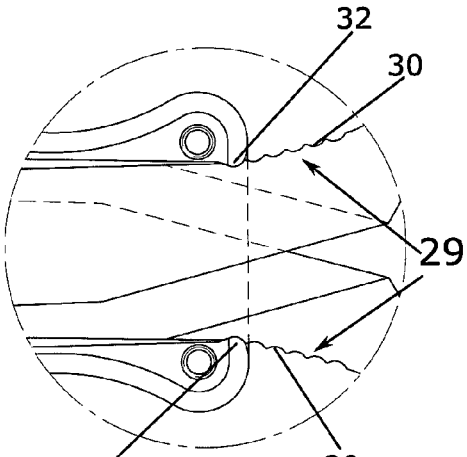

In FIG. 7A and FIG. 6A the locking mechanism of the spanner is shown. For this purpose the shoulders 28 of the jaws 4 to 7 are provided with teeth 29. Preferably, the teeth are formed by providing concave-shaped grooves or recesses 30 over the entire thickness of the jaw. At the openings of the housing, opposite the teeth, inside edges 32 are provided which fit into the recesses 30. The inner edges 32 are preferably convex-shaped, but may be provided with any possible shape in accordance with the shape of the recesses in the jaws 4-7. Due to the bias of the tension springs 24, 25 all four of the corresponding recesses 30 on the four shoulders 28, are pressed against the inside edges 32, thereby locking the two jaw arms against displacement. In order to be able to select a different nut size, the opened jaws 4, 6 or 5, 7 are moved towards each other, thereby unlocking the jaw arms 2, 3.

In FIG. 8A-8C is shown in more detail the leaf spring 24, 25 provided at it ends with the connection elements 26 in the form of (semi)-circular flanged ends, which fit into the fastening means 20 on the jaw arms 2, 3. The leaf spring is provided with a step 27 approximately the size of the thickness of the central portion 10 of the jaw arm 2, 3, since the leaf spring must pre-tension two arm portions located on different jaw arms 2, 3.

In FIG. 9A-9F an embodiment of the housing 9 is shown having a removable cover 35. The housing is provided with openings 31 for the co-operating jaw arms 2, 3. The housing 9 comprises an inner wall 36 where upon the leaf springs are supported. The housing is further provided with a top wall 33 and a bottom wall 34, which near the openings are flanged or even completely folded in order to form the respective inner edges 32 for the locking mechanism. This is an advantageous solution since no additional parts are necessary for constructing the locking mechanism.

Design alternatives and solutions for the housing may also be applied, as long as there are interior edges 32 provided for locking and for supporting the leaf springs.

What is claimed is:

1. An adjustable spanner comprising:

a pair of jaw arms, co-operating to move relative to one another, the cooperating jaw arms are each provided at their ends with a jaw, wherein two adjacent jaws constitute a spanner head, a housing for receiving the co-operating jaw arms, wherein the ends of the jaws extend outside the housing, the co-operating jaw arms slide longitudinally relative to the housing, thereby mutually tilting the jaw arms relative to one other due to the sliding, so that the jaws of the spanner head of the co-operating jaw arms move in opposite transverse direction relative to one other, the jaw arms are substantially identical, and are received in the housing being rotated 180° relative to one another about their longitudinal axis;

wherein each jaw arm comprises a central portion and said two jaws, wherein the central portion of each jaw arm comprises a guide slot and a cam.

2. The adjustable spanner according to claim 1, wherein the guide slot is substantially transverse-oriented and that the cam is provided substantially in line with the guide slot.

3. The adjustable spanner according to claim 1, wherein the cams are inserted into the guide slots of the adjacent jaw arm, in the cooperative position of the pair of jaw arms, thereby forming a pivot point of the mutual tilting movement.

4. The adjustable spanner according to claim 1, wherein said jaws are provided with a greater thickness than said central portion.

5. The adjustable spanner according to claim 4, wherein the jaws are about twice as thick as the central portion.

6. The adjustable spanner according to claim 4, wherein the thickened jaws comprise a jump or step in thickness.

7. The adjustable spanner according to claim 6, wherein the steps in thickness are provided at both ends on the same side of the jaw arm.

8. The adjustable spanner according to claim 6, wherein an angle of the step in thickness, between the jaw and the longitudinal axis, is about the same but opposite magnitude, as an angle between a lower longitudinal edge and the longitudinal axis and the angle between an upper longitudinal edge and the longitudinal axis, respectively.

9. The adjustable spanner according to claim 8, wherein each jaw arm at its upper longitudinal edge and its bottom longitudinal edge is provided with a spring fastening component.

10. The adjustable spanner according to claim 9, wherein a pivot point divides each jaw arm into two arm portions, wherein the spring fastening components are provided on different arm portions.

11. The adjustable spanner according to claim 9, wherein the spring fastening component is a recess.

12. The adjustable spanner according to claim 9, wherein a pair of tension springs are provided at inner walls in the housing, each of the pair of tension springs has at least two connection elements at both ends of the tension spring in the co-operative position of the pair of jaw arms, said at least two connection elements of the tension spring at one side of the inner walls are connected to the spring fastening components at upper longitudinal edges of the two jaw arms, and said at least two connection elements of the tension spring at the other side of the inner walls are connected to the spring fastening components at bottom longitudinal edges of the two jaw arms.

13. The adjustable spanner according to claim 12, wherein the pair of the tension springs is a pair of leaf springs.

14. The adjustable spanner according to claim 13, wherein each of the pair of the leaf spring is provided with a step corresponding to a thickness of the central portions of the pair of jaw arms in co-operative position.

15. The adjustable spanner according to claim 1, wherein the jaws of each jaw arm are provided with a shoulder, the shoulders of the two jaws of each jaw arm are provided with teeth.

16. The adjustable spanner according to claim 15, wherein the housing at both ends is provided with an opening for the jaw arms, wherein inner edges of the openings, located opposite the longitudinal edges of the jaw arms, are provided with a shape corresponding to the teeth on the shoulders of the jaw.

17. The adjustable spanner according to claim 16, wherein the teeth on the shoulder of the jaw are convex-shaped recesses, so that an inner edge provided at the opening of the housing can engage in the convex-shaped recesses of the teeth, and lock the jaw arms.

18. The adjustable spanner according to claim 15, wherein ends of top and bottom walls of the housing are flanged to form inner edges of openings of the housing.

19. The adjustable spanner according to claim 15, wherein the teeth are formed in the thickened jaw, and comprise a row of concave-shaped recesses.

20. An adjustable spanner comprising:

a pair of jaw arms, co-operating to move relative to one another, the cooperating jaw arms are each provided at their ends with a jaw, the two adjacent jaws constitute a spanner head, a housing for receiving the co-operating jaw arms, wherein the ends of the jaws extend outside the housing, the co-operating jaw arms slide longitudinally relative to the housing, thereby mutually tilting the jaw arms relative to one other due to the sliding, so that the jaws of the spanner head of the co-operating jaw arms move in opposite transverse direction relative to one other, wherein each jaw arm at its upper longitudinal edge and its bottom longitudinal edge is provided with a spring fastening component, and a pair of tension springs is provided at inner walls in the housing, each of the pair of tension springs has at least two connection elements at both ends of the tension spring, wherein in the co-operative position of the pair of jaw arms, said at least two connection elements of the tension spring at one side of the inner walls are connected to the spring fastening components at the upper longitudinal edges of the two jaw arms, and said at least two connection elements of the tension spring at the other side of the inner walls are connected to the spring fastening components at the bottom longitudinal edges of the two jaw arms.

21. The adjustable spanner according to claim 20, wherein the pair of the tension springs is a pair of leaf springs.

22. The adjustable spanner according to claim 21, wherein each of the pair of the leaf spring is provided with a step corresponding to a thickness of central portions of the pair of jaw arms in co-operative position.

23. The adjustable spanner according to claim 20, wherein the spring fastening component is a recess.

* * * * *